United States Patent [19]

Hanson

[11] 4,086,056

[45] Apr. 25, 1978

[54] PROCESS FOR IMPREGNATION OF TIMBER

[75] Inventor: Arthur Neville Hanson, Tadcaster, England

[73] Assignee: Hickson's Timber Products Limited, Castleford, England

[21] Appl. No.: 674,683

[22] Filed: Apr. 7, 1976

[30] Foreign Application Priority Data

Apr. 9, 1975 United Kingdom ..... 14607/75

[51] Int. Cl.[2] ..... B27K 3/02; B27K 3/10; B27K 5/00

[52] U.S. Cl. ..... 21/7; 427/440; 427/372 R

[58] Field of Search ..... 21/7, 64, 65; 427/372 R, 440, 441; 8/6.5

[56] References Cited

U.S. PATENT DOCUMENTS

| | | | |
|---|---|---|---|
| 609,442 | 8/1898 | Lebioda | 21/64 |
| 662,104 | 11/1900 | Stern et al. | 21/65 |
| 3,080,212 | 3/1963 | Oberley et al. | 21/7 |

OTHER PUBLICATIONS

Blake, "Seasoning . . . of Timber", 1925, pp. 100 & 101.
Hunt et al., "Wood Preservation", 1938, pp. 248–251.
Wallis-Tayler, "Preservation of Wood", 1919, pp. 126–135, 148 & 149.

*Primary Examiner*—Barry S. Richman
*Assistant Examiner*—Bradley Garris

[57] ABSTRACT

A process of impregnating one or more timber articles, such as timber doors, with a treatment agent in which the articles are placed in a treatment chamber which is then filled with the treatment agent. The treatment agent is then pressurized, preferably by pumping more treatment agent into the chamber, to force the treatment agent into the articles. This pressurizing step is performed quickly, for example, within between 5 and 25 seconds, and the articles are then removed from the chamber.

14 Claims, 1 Drawing Figure

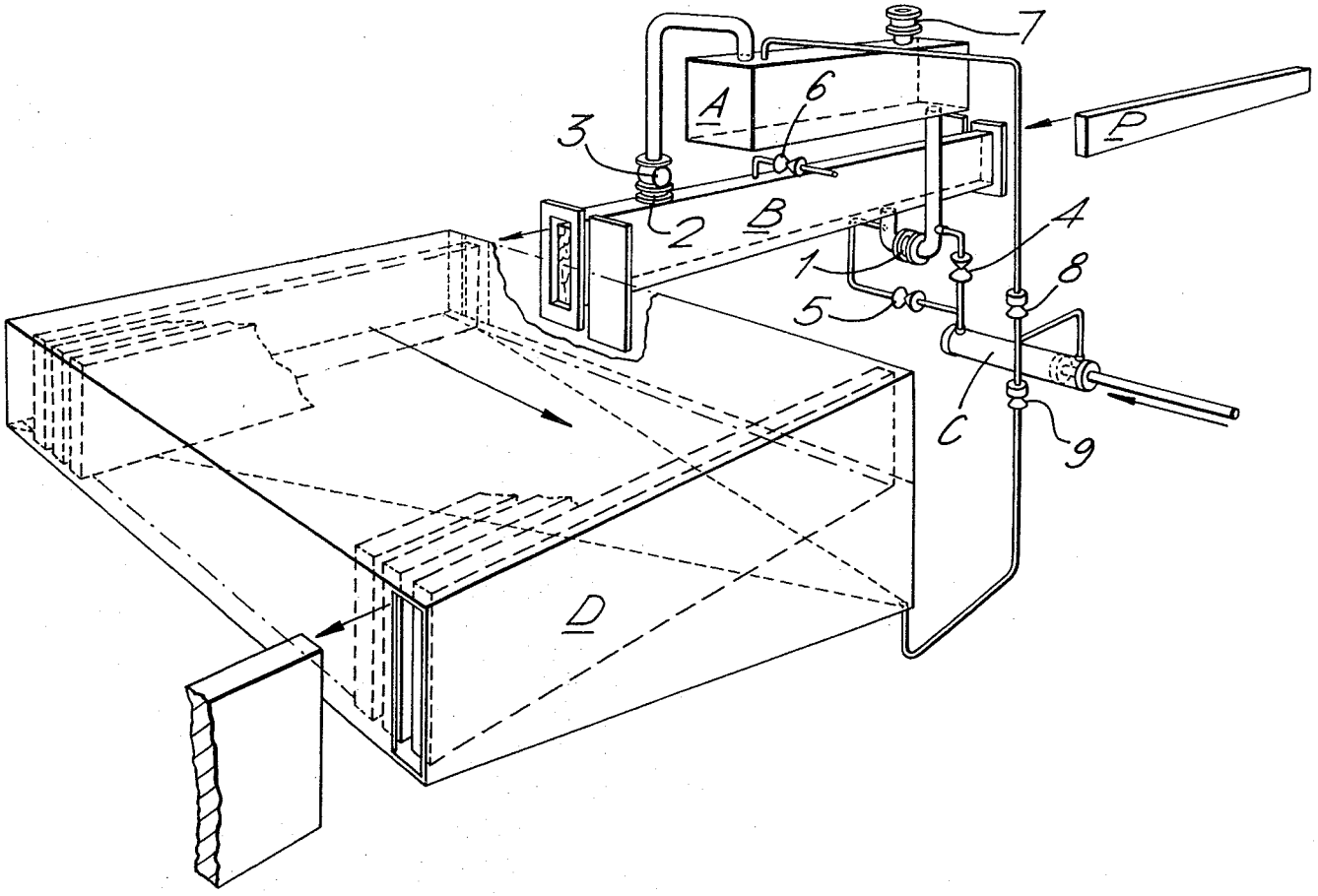
P
7
4
8
9
C
6
1
5
B
A
2
3
D

PROCESS FOR IMPREGNATION OF TIMBER

This invention relates to the impregnation of timber with treatment agents such as preservatives or fire-retardants which may include resins or colouring agents.

There are two basic ways of treating timber with such an agent. One way is to dip the timber in the treatment agent or to apply the agent with a brush, but this is only suitable when no substantial depth of impregnation is required. The other way, which is capable of effecting a desired depth of impregnation and is the one with which the present invention is concerned, is to force the treatment agent into the timber under pressure. Many such pressure impregnation processes have been proposed and used over the years, and they all have one characteristic in common. This is that they are all particularly intended for the treatment of large batches of timber (say 80 to 160 made-up doors for example) at each cycle of operation. This fact has led to the apparatus for carrying out such processes being large, complicated and expensive, and to the processes themselves comprising a considerable number of lengthy and complicated steps involving cycle times of an hour or more. Not only is the size and expense of such apparatus a disadvantage but also the apparatus is not readily adaptable to variations in the demand for treated timber brought about by, for example, seasonal or economic factors.

It is an object of the present invention to provide a comparatively inexpensive and simple process and apparatus for impregnating timber.

Viewed from one aspect the invention provides a process of impregnating one or more timber articles with a predetermined amount of treatment agent, comprising immersing said article(s) in the treatment agent in a treatment chamber and then, whilst the treatment chamber is full of treatment agent, swiftly forcing said predetermined amount of treatment agent into the said article(s) by suitably pressurising the treatment agent in the chamber, and then removing the said article(s) from the treatment chamber without any substantial delay.

Viewed from another aspect the invention provides apparatus for use in impregnating one or more timber articles with a predetermined amount of treatment agent, comprising a treatment chamber for housing said article(s), a reservoir chamber for the storage of treatment agent, said chambers being interconnected for the transfer of treatment agent therebetween, and means for swiftly forcing a predetermined amount of treatment agent into said article(s) by suitably pressurising treatment agent in said treatment chamber.

Such process and apparatus, which is notable above all for its comparative simplicity when compared with known pressure impregnation processes and apparatus, lends itself to the very speedy impregnation of only a small number of, e.g. one or two, timber articles at a time in a comparatively small and inexpensive apparatus. Thus in one embodiment of the invention one timber door at a time can be treated in a total cycle time of less than one minute (including loading and unloading the door) in apparatus whose size can be judged by the fact that it only holds about 400 liters of treatment agent as opposed to about 12000 liters in a large conventional plant.

The speed of the process of the invention as compared with conventional processes is mainly brought about by the fact that only a very small number of timber articles are treated in each cycle, because the correspondingly small size of the amount of treatment agent to be impregnated enables much simpler means to by employed for pressurising the agent in the treatment chamber. Thus such pressurisation is preferably effected by a single operation of a suitable mechanism, which mechanism in a presently preferred form of the invention comprises a simple piston pump connected to the treatment chamber. Any other convenient mechanism could be used, however, such as a rotary pump, or elevated air pressure applied directly to the agent in the treatment chamber. Conceivably the piston of a fluid-operated or mechanical ram could form one wall of the treatment chamber itself.

In a preferred process according to the invention the duration of the impregnation step, i.e. when the treatment agent is being pressurised, is from about 5 to about 25 seconds. This duration depends on the receptivity, i.e. the porosity, of the timber being treated, on the amount of treatment agent to be impregnated, and on the pressure capability of the treatment chamber. As an example a door made of hemlock, which is a timber of comparatively low receptivity, could be impregnated with an acceptable amount of treatment agent in about 10 seconds employing a maximum pressure of 7.0 kg/sq.cm, or with the same amount in about 20 seconds at a maximum pressure of 3.5 kg/sq cm. A door made of redwood, which is a much more porous timber, could be satisfactorily treated in about 5 seconds at a maximum pressure of 3.5 kg/sq.cm. However, if the timber is of a more resistant species, for example meranti (shorea spp) or gurjun (Dipterocarpus spp), and/or if the treatment agent is more viscous, for example is a resin or a primer, then the duration of the impregnation step may be increased up to about 180 seconds. Additionally, the maximum pressure employed with more resistant species may also be increased up to about 30 kg/sq cm. These figures are such as to achieve a degree of impregnation equivalent to that achieved by conventional processes.

In one form of apparatus according to the invention the means for pressurising the treatment agent is provided with two or more selectable settings for selecting the amount of agent to be pressed into a given quantity of timber. For example such pressurising means in the form of a piston pump could be provided with switching means for automatically arresting the piston movement when it has travelled different distances in its operative stroke.

Apparatus according to the invention may incorporate a drying chamber to receive and house the timber articles during a drying or so-called "recovery" period immediately after impregnation. A drain from the drying chamber may be connected to a pump for pressurising the treatment agent in such manner that agent exuded from the timber in the drying chamber is automatically returned to the reservoir by the normal operation of the pump. Heating means may be provided in the drying chamber.

The apparatus may include means for elevating the air pressure in the treatment chamber before the timber to be treated is immersed, so as to speed up the drying process by bringing about a larger pressure drop in the body of the timber when it is removed from the treatment chamber.

An embodiment of the invention will now be described by way of example and with reference to the accompanying drawing, which is a schematic perspective view of an apparatus according to the invention.

DESCRIPTION OF THE PREFERRED EMBODIMENT

For the sake of simplicity the illustrated apparatus is shown as being particularly arranged for the treatment of a single plank of timber in each cycle. Other embodiments may be particularly arranged for the treatment of, for example, either two or more timber doors or one, two or more timber window frames or components thereof in each cycle.

The principal components of the apparatus are a reservoir chamber A for liquid treatment agent, a treatment chamber B, a piston pump C and a drying chamber D. The treatment chamber B is dimensioned to snugly receive a single plank P, the space for treatment agent in the chamber about the plank being kept to a minimum so as correspondingly to minimise the amount of treatment agent which has to be transferred between the chambers A and B during each cycle. The chamber B is a pressure chamber appropriately constructed to withstand the highest pressure to be employed.

One complete cycle of operation of the apparatus will now be described.

With the reservoir chamber A full of treatment agent, the pump C primed, and all valves closed except reservoir pressure relief valve 7, a plank P is loaded into the chamber B and the chamber doors are sealed. This loading step could take about 10 seconds. Valves 1 and 2 are now opened to admit agent to the treatment chamber B by gravity and are closed when the appearance of liquid in sight-glass 3 shows that chamber B is filled and the plank is thus immersed. The quantity of agent needed to fill the chamber B (containing a plank) could be about 15 gallons and the filling step could take about 4 seconds. Valves 1 and 2 are now closed and valve 5 is opened. The pump C, which has previously been set to displace only the desired amount of treatment agent, is now actuated. The pump may be actuated by any suitable means such as a hydraulic ram (not shown). The rate at which the treatment agent is pressed into the treatment chamber is selected bearing in mind the degree of receptivity of the timber so that the peak pressure in the treatment chamber will not exceed that which might damage either the apparatus or the timber itself; some typical figures for different types of timber have already been mentioned hereinbefore. Depending on these factors, the duration of this impregnation step may be from about 5 to about 25 seconds. During its impregnating stroke the pump sucks in exuded agent from the drying chamber D through one-way valve 9. The impregnation stroke of the pump having been completed, valve 5 is closed and valve 4 is opened. Then during its return stroke, the pump is re-primed from the reservoir via valve 4 and at the same time the exuded agent from the drying chamber is returned to the reservoir via one-way valve 8. Valves 1 and 2 are opened and the agent in the treatment chamber B is returned to the reservoir A by applying air pressure, e.g. of 0.35 kg/sq cm, via valve 6; this emptying step takes about 8 seconds. The plank P is finally transferred from the treatment chamber B to the drying chamber D. The total cycle time of course varies depending on the length of the impregnation step but is typically about 1 minute for timbers such as hemlock and redwood, but may be up to 4 minutes for more resistant species.

The plank P remains in the drying chamber D for about 30 minutes, although more resistant species may remain therein for up to 120 minutes. Preferably the plank P is received on conveying means (not shown) within the drying chamber D and is slowly moved transversely of the drying chamber D in the direction of the arrow as it is dried. In this way the plank P is presented at the outlet of the drying chamber D at the end of its drying time. As described above, treatment agent recovered from the planks P during drying is sucked out of the chamber D by the pump C through one-way valve 9.

The pump C shown in the drawings is a piston pump the length of stroke of which determines the amount of treatment agent which is displaced. In some cases however the length of the pump would have to be unacceptably large to provide the required displacement and in these circumstances two or more piston pumps could be arranged side-by-side and operated simultaneously.

If required the treatment agent in the treatment chamber could be pressurized by means of compressed air instead of by a pump. In this case it would be convenient to insert a length of pipe, not shown, between the chamber B and the valve 3 having a volume equal to the quantity of treatment agent to be pressed into the full treatment chamber Initially, treatment agent would be transferred from the reservoir A to the treatment chamber B as described above until the appearance of liquid in sight-glass 3 shows that the chamber B and the length of pipe are filled. Compressed air would subsequently be admitted to the length of pipe just below the valve 2 to force the treatment agent in the pipe into the treatment chamber and thus pressurize the treatment agent in the treatment chamber.

The process described above could be automated and incorporated in a production line producing treated timber articles.

Some typical cycles suitable for the impregnation of specific types of timber with desire amounts of treatment agent by means of the above described apparatus are as follows:

| | Hemlock (*Tsuga Heterophylla*) | | Redwood (*Pinus Sylvestris*) | |
|---|---|---|---|---|
| quantity of treatment agent pressed into full treatment chamber per volume of timber to be treated ($L/m^3$) | 75 | 37 | 70 | 25 |
| total cycle time (secs) | 60 | 30 | 60 | 30 |
| minimum applied pressure ($kg/cm^2$) | 2.0 | 1.5 | 3.0 | 2.5 |
| setting of pressure relief valve ($kg/cm^2$) | 7.0 | 7.0 | 7.0 | 7.0 |
| Average absorption of treatment agent by article before drying ($L/m^3$ | 71.65 | 26.8 | 66.0 | 19.8 |
| average absorption of treatment agent by article after drying ($L/m^3$) | 61.15 | 21.9 | 58.2 | 14.9 |

At least in its preferred embodiments, the process of the present invention has a number of advantages over conventional processes in which much larger quantities of timber are treated in much longer cycles. Thus the apparatus employed is much less expensive and simpler and takes up much less space. Problems of handling and storing large quantities of timber prior to treatment are eliminated, as each timber article can be treated in a production line. The much smaller quantity of treatment agent employed at any time reduces fire hazard and also reduces the risk of pollution in the surrounding working area. The treatment of only one or two articles at a time increases the accessibility of the timber surfaces to the treatment agent which makes for more efficient impregnation and also facilitates the use of treatment agents, e.g. those incorporating primers, which make it necessary to keep the treated articles apart during drying after treatment; the post-treatment application of decorative finishes is also facilitated. Furthermore the treatment of only one or two articles at a time makes the process much more adaptable to variations in demand for the treated articles.

The table given below shows how a plant for using the process of the present invention adapted to treat three doors at a time compares with a conventional plant using a double vacuum process.

| | Plant for process of invention - three door unit | Plant using double vacuum process |
|---|---|---|
| Productive capacity-8 hour working | 1444 doors | 1444 doors |
| Cycle time | 60 secs | 40 minutes |
| Working solution quantity | 300 liters | 12000 liters |
| Overall space requirements of plant | 41.7 cu.meters | 176.7 cu.meters |
| Floor area of plant | 20 sq.meters | 90.5 sq.meters |

In addition, the plant using the double vacuum process requires more timber handling equipment than does the plant employing the present invention. Furthermore, it is necessary to provide a specially strengthened base for the double vacuum plant and this plant has a greater initial cost than that of a plant using the process of the present invention. Additionally, the double vacuum plant incorporates a vacuum pump which has to be cooled by water which is then run to waste. This is, of course, costly and there is also a risk of pollution if any treatment agent gets into the water. A plant using the process of the invention holds less treatment agent than a double vacuum plant and this reduces problems of storage and fire hazard.

Some examples of treatment agents which could be used in the process are timber preservatives such as pentachlorophenol, tri-n-butyl tin oxide and the like which are soluble in organic solvents such as white spirit, kerosene and the like, and which could incorporate other materials such as contact insecticides, paraffin wax, non-convertible resins, convertible resins and the like. Other examples of treatment agents which could be used in the process include water soluble salts and resins and the like.

What is claimed is:

1. A process for the impregnation of at least one article comprised of timber with a predetermined amount of a treatment agent comprising the steps of:

positioning an article comprised of timber in a treatment chamber;

isolating the interior of the treatment chamber from the ambient atmosphere;

filling the treatment chamber with a treatment agent;

pressurizing the treatment agent in the treatment chamber to a predetermined level for a period not exceeding 3 minutes to rapidly force the predetermined amount of treatment agent into the article in a single pressurization step; and relieving the pressure of the treatment agent at the end of said single pressurization step and removing the article from the treatment chamber without substantial delay.

2. The process of claim 1 further comprising the step of:

delivering the treated article to a drying chamber immediately upon removal from the treatment chamber; and maintaining the treated article in the drying chamber for a predetermined time.

3. The process of claim 1 wherein the step of pressurizing the treatment agent comprises:

creating and maintaining an elevated pressure within the treatment chamber for a period of between 5 and 180 seconds.

4. The process of claim 3 wherein the pressure within the treatment chamber is maintained at an elevated level for between 5 and 25 seconds.

5. The process of claim 1 wherein the step of pressurizing the treatment agent comprises:

increasing the pressure within the treatment chamber to between 1.5 and 30 kilograms per square centimeter.

6. The process of claim 5 wherein the pressure created within the treatment chamber is in the range 1.5 to 7.0 kilograms per square centimeter.

7. The process of claim 6 wherein the increased pressure is maintained in the treatment chamber for a period of between 5 and 25 seconds.

8. The process of claim 5 wherein the increased pressure is maintained in the treatment chamber for a period of between 5 and 180 seconds.

9. The process of claim 8 wherein the step of filling the treatment chamber comprises:

delivering the treatment agent from a reservoir to the treatment chamber under the influence of gravity.

10. The process of claim 9 wherein the treated article is retained in the drying chamber for a period not exceeding 120 minutes.

11. The process of claim 10 further comprising:

recovering treatment agent released from the article in the drying chamber; and returning the recovered treatment agent to the reservoir from which the treatment chamber is filled.

12. The process of claim 9 wherein the step of increasing the pressure comprises:

pumping a predetermined amount of treatment agent from a reservoir into the treatment chamber subsequent to the filling of the treatment chamber with the treatment agent.

13. The process of claim 12 further comprising the step of:

delivering the treated article to a drying chamber upon removal from the treatment chamber.

14. The process of claim 13 wherein the treated article is maintained in the drying chamber for approximately 30 minutes.

* * * * *